US011834084B2

(12) United States Patent
Hammerl et al.

(10) Patent No.: US 11,834,084 B2
(45) Date of Patent: Dec. 5, 2023

(54) METHOD FOR MIXED OPERATION OF A SECTION OF RAILROAD LINE WITH SWITCH, AND SECTION OF LINE AND SWITCH

(71) Applicant: SIEMENS MOBILITY GMBH, Munich (DE)

(72) Inventors: Malte Hammerl, Braunschweig (DE); Jacob Johannes Kohlruss, Braunschweig (DE)

(73) Assignee: Siemens Mobility GmbH, Munich (DE)

( * ) Notice: Subject to any disclaimer, the term of this patent is extended or adjusted under 35 U.S.C. 154(b) by 693 days.

(21) Appl. No.: 16/823,461

(22) Filed: Mar. 19, 2020

(65) Prior Publication Data

US 2020/0307663 A1 Oct. 1, 2020

(30) Foreign Application Priority Data

Mar. 26, 2019 (DE) ..... 102019204135

(51) Int. Cl.
*B61L 27/20* (2022.01)
*B61L 1/14* (2006.01)
(Continued)

(52) U.S. Cl.
CPC ..... *B61L 27/20* (2022.01); *B61L 1/14* (2013.01); *B61L 19/00* (2013.01); *B61L 23/14* (2013.01);
(Continued)

(58) Field of Classification Search
CPC .. B61L 1/14; B61L 19/00; B61L 23/14; B61L 27/04; B61L 27/20; B61L 27/30; B61L 2027/204; B61L 2201/00
See application file for complete search history.

(56) References Cited

U.S. PATENT DOCUMENTS 5,437,422 A * 8/1995 Newman ..... B61L 27/20 246/5
2007/0162199 A1 7/2007 Katsuta et al.
(Continued)

FOREIGN PATENT DOCUMENTS

AU 2014100586 A4 7/2014
DE 19526158 A1 7/1997
(Continued)

*Primary Examiner* — Zachary L Kuhfuss
(74) *Attorney, Agent, or Firm* — Laurence A. Greenberg; Werner H. Stemer; Ralph E. Locher

(57) ABSTRACT

In a method for mixed operation of a section of railroad line, the section of line is trafficable by trains equipped with a train control system, and by trains not equipped with this train control system. The section of line is provided with a switch so that in the event that a train not equipped with the train control system is to enter the section of line from the direction of a side track, the section of line is indicated as occupied. The occupied indication is triggered by a first throwing of the switch in the direction of the side track. After the train not equipped with the train control system has passed through, the occupied indication is canceled. The cancelation is triggered by a second throwing of the switch. After throwing of the switch, a clearing run is carried out on the section of line by an equipped train.

9 Claims, 1 Drawing Sheet

(51) Int. Cl.

| | |
|---|---|
| ***B61L 27/04*** | (2006.01) |
| ***B61L 23/14*** | (2006.01) |
| ***B61L 19/00*** | (2006.01) |

(52) U.S. Cl.
CPC ..... *B61L 27/04* (2013.01); *B61L 2027/204* (2022.01); *B61L 2201/00* (2013.01)

(56) References Cited

U.S. PATENT DOCUMENTS

| | | | | |
|---|---|---|---|---|
| 2010/0090069 | A1 | 4/2010 | Degouge et al. | |
| 2015/0307119 | A1 | 10/2015 | Ghaly | |
| 2020/0017131 | A1* | 1/2020 | Houghton ..... | B61L 27/70 |

FOREIGN PATENT DOCUMENTS

| | | | |
|---|---|---|---|
| DE | 69307494 | T2 | 7/1997 |
| DE | 102016203694 | A1 | 9/2017 |
| DE | 102016203695 | A1 | 9/2017 |
| EP | 2836412 | B1 | 9/2018 |
| WO | 2015163947 | A1 | 10/2015 |

* cited by examiner

METHOD FOR MIXED OPERATION OF A SECTION OF RAILROAD LINE WITH SWITCH, AND SECTION OF LINE AND SWITCH

CROSS-REFERENCE TO RELATED APPLICATION

This application claims the priority, under 35 U.S.C. § 119, of German application DE 10 2019 204 135, filed Mar. 26, 2019; the prior application is herewith incorporated by reference in its entirety.

BACKGROUND OF THE INVENTION

Field of the Invention

The invention relates to a method for mixed operation of a section of railroad line, the latter being trafficable by trains equipped with a train control system, in particular CBTC, and by trains not equipped with the train control system, and the section of line having at least one switch.

The invention also relates to a section of railroad line having a train control system, in particular CBTC, the section being trafficable by trains equipped with the train control system and by trains not equipped with the train control system, and the section of line having at least one switch.

In large conurbations, old train control and signaling technology (i.e. lineside train control equipment) which is based on conventional track occupancy detection and signals is being increasingly replaced by modern systems. When the new train control systems are installed, movement authority can be displayed directly in the driver's cab via wireless transmission (and can also be monitored by on-board equipment). This makes the lineside signals (i.e. the lineside control equipment) superfluous for trains equipped with these new train control systems. In the context of this invention, a distinction is therefore drawn between the train control equipment that is always installed lineside, and train control systems with which trains are equipped, the train control systems making train control equipment (lineside) superfluous for the trains in question. The train control system used can be, for example, communications-based train control (CBTC).

In many conurbations, main-line passenger trains and long-distance freight trains that are not equipped with the new train control system occasionally operate together with the equipped local trains in a mixed traffic environment. The lineside signals would now have to be retained solely for the main-line traffic on the corridors affected, although they are no longer required by the mainly local traffic. Signals have to be maintained, and maintenance can be quite expensive. If the corridor carrying the mixed traffic is quite long and the amount of main-line traffic compared to local traffic is relatively small, it is not therefore cost-effective to retain the lineside signals.

In order to increase cost-effectiveness, it would be possible to thin out the lineside signals and set up very long routes possibly extending over several kilometers up to 50 km. The disadvantage of such a long route would in turn be that no other train movements could take place for a long time before the passage of the non-local train, as the track elements are reserved for the route of the non-local train.

This would in turn place a constraint on the much higher frequency local traffic, which would be unacceptable particularly at peak periods.

BRIEF SUMMARY OF THE INVENTION

The object of the invention is therefore to specify a method for mixed operation of a section of railroad line (i.e. trafficking by trains equipped with a train control system and by trains not equipped with the train control system using lineside train control equipment), the method being both cost-effective in terms of the required train control components of the lineside train control system and efficient in terms of the capacity utilization of the section of line by trains both with and without an installed train control system. The object of the invention is also to specify a section of line with which the method can be carried out.

This object is inventively achieved as follows by the method as set forth in the introduction:

a) in the event that a train not equipped with the train control system is to enter the section of line from the direction of a side track, the section of line is indicated as occupied, wherein the occupied indication is triggered by a first throwing of the switch in the direction of the side track, and b) after the train not equipped with the train control system (referred to hereinafter as the unequipped train for short) has passed through, the occupied indication is canceled, the cancelation being triggered by a second throwing of the switch in the direction of the section of line (AC).

The invention therefore relates to a scenario in which long sections of line having at least one or a plurality of side track junction points are available, wherein trains that are not equipped with the train control system are to use the line and wherein these trains are to enter the section of line from the side track junction point. The side track leading to the side track junction point is not equipped with the train control system (in particular not with CBTC). After entering via the side track switch, the unequipped trains pass through the section of line equipped lineside with the control system. In addition, there will preferably no longer be signals on the section of line, either to protect junctions or for sectionalization. At least a large number of the signals will be eliminated, but there can be a signal at the start and end of the section of line. Also, track occupancy detection using axle counters or track circuits shall preferably not be provided.

The switch is inventively used to advantageously provide a reliable device for generating occupied indications even without signals. If the switch is thrown in the direction of the side track, this automatically triggers the occupied indication. Otherwise the occupied indication is canceled again when the switch is thrown in the direction of the section of line. For safety reasons, however, the canceling of the occupied indication does not yet cause the section of line to be released, as after passage of the unequipped train it cannot be guaranteed that the section of line is really unoccupied. For example, it could happen that the unequipped train has undetectably lost a car.

According to an embodiment of the invention it is provided that, after the second throwing of the switch, a track clearing run is carried out on the section of line by a train equipped with the train control system (hereinafter referred to as an equipped train) before the section of line is released for operation of trains equipped with the train control system.

As soon as an equipped train has carried out the clearing run, the section can be released again, as this train is monitored via the control system and, as a result, the possibility of a car of this equipped train remaining undetected on the section of line, for example, can be eliminated. The use of an equipped train for the track clearing run can be advantageously predefined by the schedule of the equipped trains. The train performing this run merely needs to be operated at reduced speed to ensure that the driver of the equipped train can make a visual inspection. For example, a speed of 40 km/h can be maintained to allow timely braking in the event of obstacles on the section of line.

According to an embodiment of the invention it is provided that, prior to the second throwing of the switch, a track clearing run is carried out using a train equipped with the train control system from the direction of the side track before the section of line is released for operation of trains equipped with the train control system after the second throwing of the switch.

This variant of the method according to the invention is advantageous if an equipped train is to begin operating on the section of line starting from said side track. For example, the side track is used to introduce equipped trains into the section of line from a depot. This is required, for example, if the schedule of a mass transit system (e.g. at commuting times) necessitates tighter headways, so that additional equipped trains have to be deployed. Advantageously, traversal of the section of line from the side track to the end of the section of line is sufficient, because only this region of the section of line was also traversed by the unequipped train. After a run on this part of the section of line only, the entire section of line can therefore then be released again, as the part of the section of line not traversed was not traversed by an unequipped train.

According to an embodiment of the invention, it is provided that the release for operation by trains equipped with the train control system is canceled if the position of the switch is not known.

This is advantageously an additional safety device which can prevent train accidents from occurring. As an occupied indication for the section of line while it is being traversed by unequipped trains is made dependent solely on the switch position, this is a safety-relevant element in the train control system that acts lineside. For the case that the switch position cannot be determined in the event of a fault, canceling of the release for operation is a measure for increasing operational safety.

According to an embodiment of the invention, it is provided that each time the switch is thrown in the direction of the section of line, it triggers a derailer on the side track which prevents the side track from being traversed.

A derailer is to be understood as meaning a mechanical safety device which, when run over by a train, causes a controlled derailment of the train. This is inventively a safety precaution that can be employed on the side track. Self-evidently the derailer is only to be used if the actually installed safety equipment of the train control system, e.g. a color light signal, has failed or has been ignored.

According to an embodiment of the invention, it is provided that operation on the side track is controlled by track safety equipment other than the train control system.

Advantageously, the side track does not need to be equipped with the train control system that is used for equipped trains on the section of line. This advantageously increases the cost-effectiveness of the solution according to the invention. The side track can be equipped, for example, with a lineside train control system of the type normally used e.g. for main-line or freight traffic. This provides a simple means of also providing mixed operation of the section of line.

Another advantage is that the train control system on the section of line does not need to communicate with the track safety equipment for the side track. According to the invention, the position of the switch is actually the determining factor in ensuring that both rail networks, namely the one of which the section of line is part and the one of which the side track is part, can obtain train-control-relevant information by means of the switch position.

The stated object is alternatively achieved according to the invention by the claim subject matter (section of line) mentioned in the introduction as follows:

a) an occupied indication for the section of line can be triggered by a first throwing of the switch in the direction of a side track, and
b) the cancelation of the occupied indication can be triggered by a second throwing of the switch in the direction of the section of line.

The section of line according to the invention therefore has all the technical prerequisites for carrying out the method described in the foregoing. In this respect the advantages explained for the above method also apply to the section of line. In particular, mixed operation of equipped trains and unequipped trains on the section of line is possible while simultaneously maintaining high safety standards. An occupied indication is triggered by the switch position, thereby preventing accidents between equipped and unequipped trains.

According to an embodiment of the invention, it is provided that the release for operation of trains equipped with the train control system can be cancelled if the position of the switch is not known. The advantages of this design have likewise already been explained above.

According to an embodiment of the invention, it is provided that at least one of the ends of the section of railroad line is equipped with a light signal.

The color light signal or signals advantageously provide an additional safety device so that mixed operation (of equipped and unequipped trains) can be carried out more safely. In particular, unequipped trains can be prevented from entering adjacent sections of line that are still released for operation by equipped trains. The adjacent sections of line would then first have to be indicated as occupied if the unequipped train is given authority to proceed via the color light signal. On the other hand, color light signals are only necessary at the start and/or at the end of the section of line, so that the number thereof can be advantageously reduced. This means lower capital costs for equipping the section of line and lower maintenance costs for operating the section of line.

According to an embodiment of the invention, it is provided that the apparatus has interfaces for outputting a code relating to the switch position for two interlockings, wherein one interlocking is equipped for operation using an automatic train control system.

The code can be an electrical signal or a mechanical state. An electrical signal is required, for example, so that the switch position can be fed into the train control system for equipped trains. On the side track, a conventional mechanical train control system for the line can be used, for example, wherein the switch position is likewise taken into account by mechanical means. Self-evidently, the side track interlocking can also be supplied with electrical signals if it is computer-controlled.

According to an embodiment of the invention, it is provided that electrical rail contacts for triggering the clear indication and/or the occupied indication are incorporated in the apparatus.

Electrical rail contacts advantageously provide a simple and reliable means of determining the rail location and generating electrical signals indicating the rail position. These can be further processed in the train control system for the section of line and the interlocking for the side track.

According to an embodiment of the invention, it is provided that the triggering of the clear indication and/or of the occupied indication is implemented in the apparatus by an interlocking bed.

Interlocking beds provide a proven method of detecting mechanical states such as the switch position. The switch position can be detected in this way for a mechanical train control system.

Further details of the invention will now be described with reference to the accompanying drawings. Identical or corresponding elements will be provided with the same reference character in each case and will only be explained again where differences arise between the individual figures.

The examples explained in the following are preferred embodiments of the invention. In the exemplary embodiments, the described components of the embodiments constitute individual features of the invention which are to be considered independently of one another, which also further develop the invention independently of one another and are therefore also to be regarded as integral to the invention either individually or in a combination other than that shown. In addition, the embodiments described can also be supplemented by other of the already described features of the invention.

Other features which are considered as characteristic for the invention are set forth in the appended claims.

Although the invention is illustrated and described herein as embodied in a method for mixed operation of a section of railroad line with switch, and section of line and switch, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
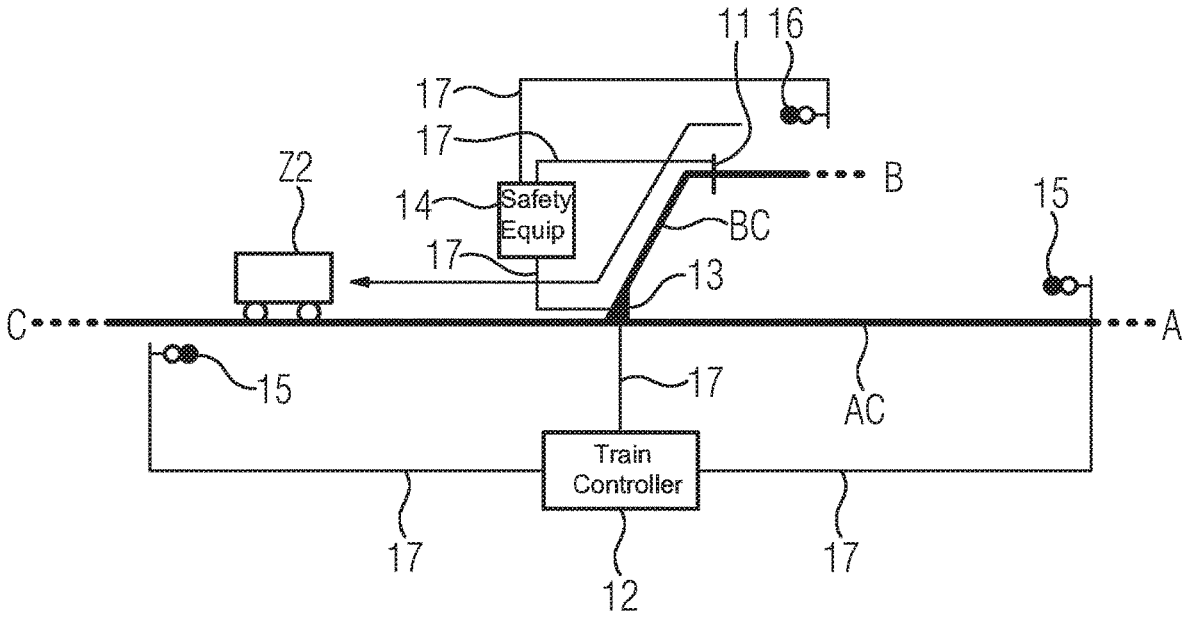
FIG. 1 schematically illustrates by way of example a step in an exemplary embodiment of a method according to the invention using an exemplary embodiment of a section of line according to the invention and an exemplary embodiment of a switch according to the invention, wherein a passage of an unequipped train is shown.

Referring now to the figures of the drawings in detail and first, particularly to FIG. 1 thereof, there is shown a section of line AC which is equipped with a train control system 12, in particular CBTC, and can be used both by trains Z1 equipped with the train control system (cf. FIG. 2) and by trains Z2 not equipped with this train control system. The section of line AC also has color light signals 15.

The train control system 12 can be e.g. a system which is known commercially as CBTC or Trainguard MT. This system is based on so-called tracking of all equipped trains, i.e. the instantaneous position of these trains is always known. In addition, a necessary braking distance for these trains is allowed for which defines a safety distance from other equipped trains. The length of line required by the train by virtue of its dimensions and the braking distance to be allowed for is also known as moving block. Taking the moving block into account means that no track vacancy indications need to be provided lineside, as long as only equipped trains are present in the section of line AC.

A side track BC branches off the section of line AC. This side track is set by the switch 13. The side track BC has a derail 11 and is equipped with track safety equipment 14. The side track BC also has a subsidiary signal 16. The train control system 12, the track safety equipment 14, the switch 13 and the color light signals 15, 16 are controlled via signal connections 17.

As can be seen from FIG. 1, the unequipped train Z2 is already on the section of line AC beyond the turnout to the side track BC. The unequipped train Z2 has come from the side track BC and will leave the section of line AC at C.

The color light signals 15 are used to block the section of line AC for unequipped trains Z2. In addition, the unequipped train Z2 cannot enter the line section (not shown) following the section of line AC if the color light signal is on "Red".

Figure 2:
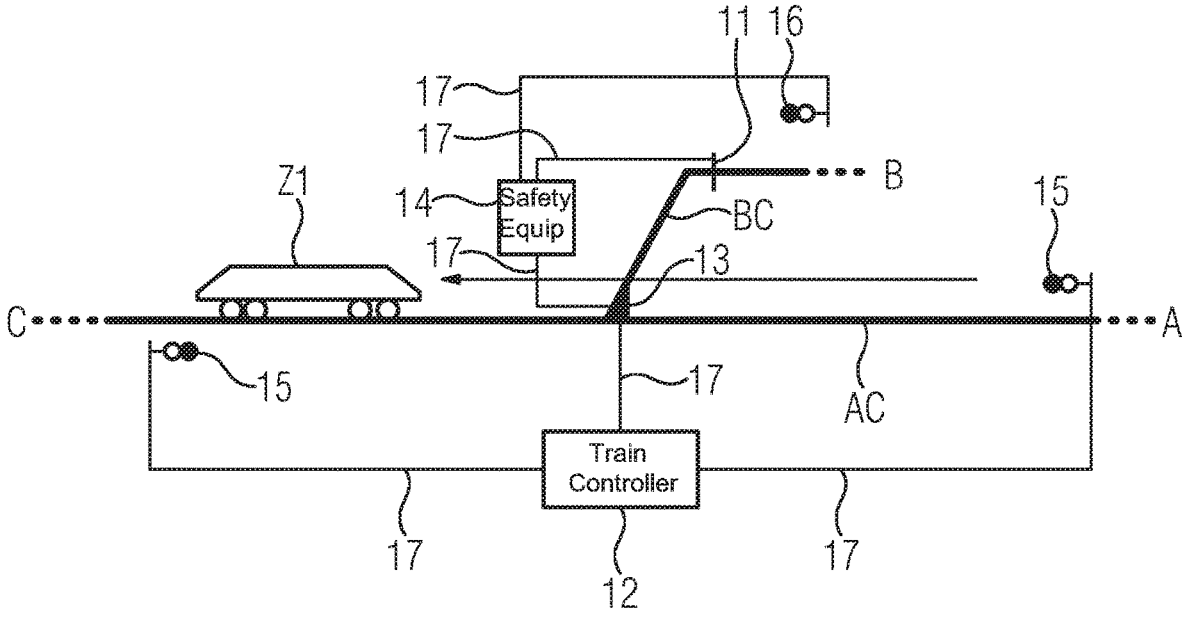
FIG. 2 schematically illustrates another step in the exemplary embodiment of the method according to the invention as shown in FIG. 1 using the exemplary embodiment of the section of line according to the invention and the exemplary embodiment of the switch according to the invention, wherein the track clearing run of an equipped train is shown.

FIG. 2 shows the scenario according to FIG. 1 at a later point in time. The section of line AC is now being used by an equipped train Z1. To ensure that the section of line AC is clear, the equipped train Z1 carries out a track clearing run. At this point in time, the color light signal 15 is on "Green".

The derail 11 is activated so that no unequipped train Z2 can enter the section of line AC. At this time the switch 13 is also reset and the subsidiary signal 16 is on "Red".

On completion of the track clearing run, the section of line AC is released for equipped trains Z1, so that the train control system 12 can resume unrestricted operation.

LIST OF REFERENCE CHARACTERS

AC section of line
BC side track
11 derail
12 train control system (section of line)
13 switch
14 track safety equipment (side track)
15 color light signal
16 subsidiary signal
17 signal connection
Z1 equipped train
Z2 unequipped train

The invention claimed is:

1. A method for mixed operation of a section of railroad line, the section of railroad line being trafficable by trains equipped with a train control system and by trains not equipped with the train control system and the section of railroad line being provided with at least one switch, which comprises the steps of:

indicating the section of railroad line as occupied in an event that a train not equipped with the train control system is to enter the section of railroad line from a direction of a side track, wherein an occupied indication is triggered by a first throwing of the switch in the direction of the side track;

cancelling the occupied indication after the train not equipped with the train control system has passed through, a cancelation being triggered by a second throwing of the switch in a direction of the section of railroad line; and carrying out a track clearing run at a reduced speed of operation to ensure that the driver of the equipped train can make a visual inspection to allow timely braking in the event of obstacles on the section of line using a train equipped with the train control system, by either:

after the second throwing of the switch, carrying out the track clearing run on the section of railroad line using the train equipped with the train control system before the section of railroad line is released for operation by the trains equipped with the train control system;

or prior to the second throwing of the switch, carrying out the track clearing run using the train equipped with the train control system from the direction of the side track before the section of railroad line is released for operation by the trains equipped with the train control system after the second throwing of the switch.

2. The method according to claim 1, which further comprises cancelling a released for operation by the trains equipped with the train control system if a position of the switch is not known.

3. The method according to claim 1, wherein after each throwing of the switch in the direction of the section of railroad line, a derail on the side track is activated which prevents the side track from being traversed.

4. The method according to claim 1, which further comprises controlling an operation on the side track by track safety equipment other than the train control system.

5. The method according to claim 1, wherein the train control system is a communications-based train control (CBTC) system.

6. A section of railroad line, comprising:

a train control system where the section of railroad line being trafficable by trains equipped with said train control system and by trains not equipped with said train control system;

at least one switch, and an occupied indication for the section of railroad line can be triggered by a first throwing of said switch in a direction of a side track, and cancelation of the occupied indication can be triggered by a second throwing of said switch in a direction of the section of railroad line;

said train control system configured to carry out a track clearing run at a reduced speed of operation to ensure that the driver of the equipped train can make a visual inspection to allow timely braking in the event of obstacles on the section of line by either:

after the second throwing of said switch, carrying out the track clearing run on the section of railroad line using a train equipped with the train control system before the section of railroad line is released for operation by said trains equipped with the train control system;

or prior to the second throwing of said switch, carrying out the track clearing run using the train equipped with the train control system from the direction of said side track before the section of railroad line is released for operation by said trains equipped with the train control system after the second throwing of said switch.

7. The section of railroad line according to claim 6, which further comprises canceling a release for operation by the trains equipped with the train control system if a position of the switch is not known.

8. The section of railroad line according to claim 6, wherein at least one end of the section of railroad line is equipped with a color light signal.

9. The section of railroad line according to claim 6, wherein said train control system is a communications-based train control (CBTC) system.

* * * * *